United States Patent [19]

Sirois

[11] Patent Number: 4,962,373

[45] Date of Patent: Oct. 9, 1990

[54] SCHEME FOR POWER CONSERVATION IN FIRE ALARM SYSTEM

[75] Inventor: Brian D. Sirois, Harwinton, Conn.

[73] Assignee: General Signal Corporation, Stamford, Conn.

[21] Appl. No.: 345,597

[22] Filed: May 1, 1989

[51] Int. Cl.[5] ..... G08B 23/00

[52] U.S. Cl. ..... 340/693; 340/505; 340/518; 340/533

[58] Field of Search ..... 340/693, 584, 505, 518, 340/533–4, 825.54, 825.08

[56] References Cited

U.S. PATENT DOCUMENTS

| | | | |
|---|---|---|---|
| 4,103,337 | 7/1978 | Whiteside | 340/505 X |
| 4,489,312 | 12/1984 | Yoshizaki | 340/518 X |
| 4,506,255 | 3/1985 | Saski | 340/518 X |
| 4,518,952 | 5/1985 | Tanaka et al. | 340/514 |
| 4,525,700 | 6/1985 | Kimura et al. | 340/518 |
| 4,531,114 | 7/1985 | Topol et al. | 340/533 X |
| 4,550,306 | 10/1985 | Kimura | 340/310 R |
| 4,581,604 | 4/1986 | Kimura et al. | 340/521 |
| 4,636,649 | 1/1987 | Kimura et al. | 340/505 X |
| 4,658,243 | 4/1987 | Kimura et al. | 340/505 |
| 4,668,939 | 5/1987 | Kimura et al. | 340/521 |
| 4,673,920 | 6/1987 | Ferguson et al. | 340/505 X |
| 4,701,625 | 10/1987 | Kimura | 340/505 X |
| 4,725,819 | 2/1988 | Sasaki et al. | 340/517 |
| 4,725,821 | 2/1988 | Kimura et al. | 340/529 |
| 4,733,224 | 3/1988 | Kimura | 340/505 X |
| 4,742,335 | 5/1988 | Vogt | 340/518 |
| 4,850,018 | 7/1989 | Vogt | 340/505 X |

*Primary Examiner*—Joseph A. Orsino

*Assistant Examiner*—Thomas J. Mullen, Jr.

*Attorney, Agent, or Firm*—Robert R. Hubbard; John F. Ohlandt

[57] ABSTRACT

An arrangement for conserving the alarm-state power supplied to numbers of light emitting devices included in respective addressable terminal units of a fire alarm system or the like. The addressable terminal units are connected to a transmission line or loop; and a loop controller cyclically transmits address signals to the terminal units (polling routine); the controller functions, responsive to received data from those units, to generate an alarm-state display command signal for causing illumination of the light emitting devices of terminal units that are in alarm. In the case where a terminal unit comprises a master transponder to which a group of non-addressable conventional "slave" detectors is connected, the loop controller is programmed to disconnect such slave detector from the loop or line when more than one of them is in alarm. However, in the event of a large number of terminal units at scattered locations being in alarm, a tell-tale signal from each unit is highly desirable. Accordingly, it is arranged that all of their light emitting devices will be capable of indicating an alarm state. To this end, a blinking mode of operation is selected, whereby limited groups of devices (except for one) are turned on in sequence, the "ON" times being the same for all off the devices, but the "OFF" times being varied in dependence on the total number of devices being supplied with power. Consequently, power ON is time-divided among the groups, so that the total power consumed by all groups is no greater than would be consumed by a single group.

10 Claims, 2 Drawing Sheets

SCHEME FOR POWER CONSERVATION IN FIRE ALARM SYSTEM

BACKGROUND OF THE INVENTION

The present invention relates to an alarm system, and more particularly, to a fire alarm system in which groups of addressable terminal units are connected to respective transmission loops, synchronous power and serial data transmission being effectuated over such loops.

The arrangement or scheme in accordance with the present invention may be appreciated in connection with the complete fire alarm system disclosed in related applications ED-244 and ED-246, the details of which are incorporated herein by reference. In both of those applications, the particular relationship between the loop controller, described herein for controlling a given loop or line, and the master controller, which controls all aspects of the system, will be apparent. It will be especially appreciated that when data is sent back to the loop controller discussed herein, it is further transmitted, in accordance with the complete system of the two related applications, to a master controller so that indications can be given at a central control panel of the conditions existing at all of the detectors, sensors, and devices of various other types included in all the loops forming the system. The master controller is operative to generate an audible alarm, and a display, at the control panel to alert personnel at that central location when terminal units are in alarm or there is trouble anywhere in the system, and further to cause a print record to be made of such conditions.

It is desirable at the same time to indicate at a particular terminal unit that such unit is in an alarm state so that supervisory personnel can pinpoint that location and hence be able to take remedial action.

However, a significant difficulty occurs in the event that a large number of terminal units go into the alarm state. One form of terminal unit includes a new-style, completely addressable, analog detector which is packaged with a "chip" or "chips" embodying components such as an address comparator, an A to D convertor, a command discriminator, etc. In this connection, reference can be made to U.S. Pat. No. 4,581,604 for a description of this type of terminal unit.

The detectors of such terminal units can be accessed in a cyclical manner, such as by a so-called polling routine; data on the state of the detector can then be sent back to a loop controller, and commands given to the terminal unit by that loop controller. The term transponder, as used in the current description, refers to a form of terminal unit like the first, except that conventional "slave" detectors, or other initiating devices, are connected to the chip, the transponder being accessed in the same manner as a terminal unit featuring the new-style analog detector. The slave detectors, or other initiating devices, however, are not individually addressable.

The difficulty already referred to is that when a large number of terminal units are in the alarm state, an unacceptably high power drain is involved. For example, since conventional detectors used in connection with a transponder individually draw approximately 15 milliamps, it is intolerable to have more than one of these indicating its alarm state because, in that situation, excessive power would be consumed.

Accordingly, it is a principal object of the present invention to conserve power consumption on a loop when any type of terminal units go into alarm. To this end, significant power savings are obtained by disconnecting the slave initiating devices of the type of unit defined above as a transponder after the central panel has already latched the alarm state indication from that transponder.

Another goal or object is always to allow every terminal unit to indicate an alarm state. Heretofore, it had become the practice to illuminate the light emitting devices of the first ten units when they come into alarm. However, this has been found to be unsatisfactory because, as currently designed, transponders located on the loop still draw their 15 milliamps of alarm current.

SUMMARY OF THE INVENTION

The present invention overcomes the difficulties, noted above, by providing an alarm system in which occurrence of an alarm state is indicated at a terminal unit near the location of the detected fire so that maintenance personnel can readily confirm the location where fire has broken out, while keeping power consumption on the loop to a minimum.

In achievement of the above and other objects of the present invention, an arrangement is provided whereby if the first alarm given is from a slave detector connected to a transponder, the slave detector will maintain power such that the light emitting devices on the slave detector will remain illuminated; and, of course, the light emitting device on the transponder will also be illuminated. This will serve to assist trouble shooting in the event of a false alarm.

In the event, however, that other slave detectors connected to a given transponder report their alarm states to the panel, the loop controller will then send out a command that will cause power to be disconnected from the slave detectors, resulting in non-illumination of the light emitting device for each of the slave detectors connected to that transponder. At this point, the transponder is only drawing its standby current, approximately 300 milliamps. However, the light emitting device of the transponder will illuminate when, as explained later, it is blinked during a blink routine. The slave detectors and their light emitting devices are reconnected or blinked.

In the case of plural terminal units being in the alarm state, whether they be transponders or units having analog detectors, once the loop controller detects that more than one terminal unit is in an alarm state, power is conserved by reason of an arrangement that calls forth a blinking routine in the program. What this routine involves is turning on the light emitting devices of terminal units in groups of five. In other words, it is a scheme for providing an alarm indication for all terminal unit light emitting devices, but on a blinking basis, i.e., for a limited ON time for each of the units but with a variable OFF time depending on the number of units involved. This feature will be thoroughly appreciated as the description proceeds.

Accordingly, a principal feature of the invention may be defined as apparatus for conserving the alarm-state power supplied to a plurality of light emitting devices associated with respective terminal units in a fire alarm system comprising a transmission line or loop; a plurality of terminal units connected to said transmission line; each of said terminal units having comparison means for determining whether a received address signal coincides with an identification address stored in the terminal unit, said comparison means producing an output signal responsive to coincidence; a loop controller connected to the transmission line for transmitting a plurality of address signals cyclically to said terminal units, and further including means for selecting a blinking mode of operation for said light emitting devices of the terminal units, whereby the ON times for all said devices are the same, but the OFF times are varied in dependence on the number of light emitting devices being supplied with power.

The context for the principal feature noted above may be more specifically defined as comprising a loop controller for additionally generating an alarm-state display command signal when received response data from a terminal unit determines that an alarm state exists, said command signal causing a visible indication at the light emitting devices of such terminal units. Accordingly, the blinking mode of operation just referred to affects the command signal on a time sharing basis.

Another principal feature is the arrangement already described in the context described above whereby conventional slave detectors connected to a transponder are disconnected upon the situation arising that more than one of said slave detectors is in an alarm state. Thus, the advantage is gained of having at least one slave detector being able to pinpoint a very precise location, provided it is the only detector in alarm, but, when more than one of these is in alarm, the transponder itself continues to provide an indication by reason of illumination of its light emitting device even though all of the slave detectors have been disconnected.

Other and further objects, advantages and features of the present invention will be under stood by reference to the following specification in conjunction with the annexed drawing, wherein like parts have been given like numbers.

DETAILED DESCRIPTION OF THE PREFERRED EMBODIMENT

Figure 1:
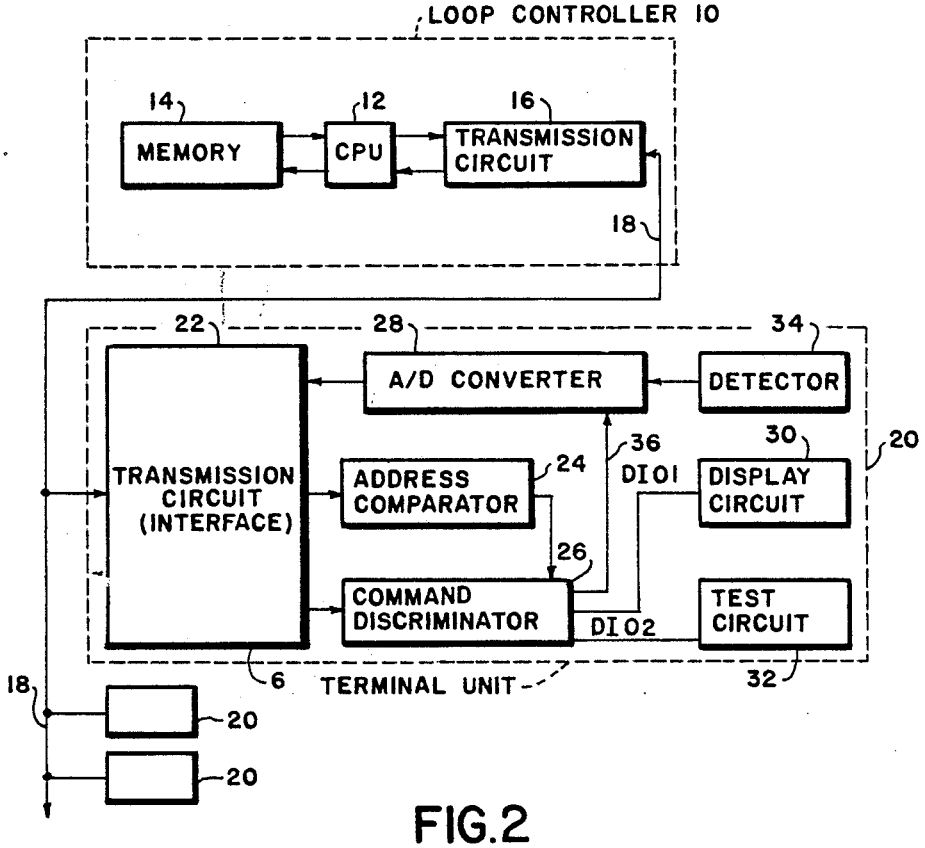
FIG. 1 is a block diagram of a fire alarm system according to a preferred embodiment of the invention.

A fire alarm system according to a preferred embodiment of the present invention will be first described in detail with reference to FIG. 1.

A loop controller 10 includes a central processing unit 12, a memory 14, and a transmission circuit or interface 16. As noted previously, the loop controller communicates with a master controller (not seen) forming part of a control panel arrangement at a central station.

A program, involving the storage of data in a plurality of registers constituting the memory 14, is executed by the CPU 12 in a manner wellknown to those skilled in the art. The CPU 12 supplies address and command signals to the transmission circuit or interface 16 for transmission on a serial basis by the transmission line or loop, shown as a single line 18, to the individual terminal units 20.

A similar transmission circuit or interface 22 at a terminal unit 20 converts the serial data on the line 18 to parallel data having predetermined levels. In each of the terminal units 20, an address comparator 24 compares the address represented by the transmitted address signal with a 7 bit address assigned to that particular terminal. When these addresses coincide, the command discriminator 26 is operative to discriminate among various types of command data. For example, when the command data indicates that data should be transmitted from a terminal unit 20 to the loop controller 10, the command discriminator 26 causes an A to D converter 28 to transmit digital data concerning the operative state onto the transmission line 18.

On the other hand, when the command data directs that an indication be displayed at the terminal unit, the command discriminator 26 causes a signal to be transmitted on line DIO1 to the display circuit 30, thereby to cause, for example, a light emitting device forming part of that display circuit, to be illuminated. Such illumination may also be accompanied by an audible alarm. Furthermore, additional relay circuits can be activated for special purposes, such as, for example, a relay in a test circuit 32 seen connected by way of a line DIO2 to the command discriminator 26.

It will be appreciated that the A to D converter 28 normally receives an analog output signal from a detector 34, such as a smoke detector or the like, and converts that analog signal to corresponding digital data which is sent through the transmission circuit 22 in response to an output signal on connection 36 from the command discriminator to the A to D converter.

In normal operation of the embodiment of FIG. 1, the loop controller 10 cyclically generates an address signal for each terminal unit 20 and a data transmission command signal for each terminal unit. The response data from each terminal unit 20 is generally processed in accordance with a program stored in the memory 14. Thus, response data from the given terminal unit is compared with reference data in the memory. If the response data is greater than the reference data thresholds, the CPU 12 may determine that a fire has broken out, thereby causing a display on the main panel to displaY the number of the particular terminal unit 20 that is in alarm. At the same time, an audible fire alarm is generated at the central station and the CPU 12 transmits a fire display command to that terminal unit 20. Upon receipt of such command, the corresponding command discriminator 26 deciphers the fire display command and causes the display circuit 30 to indicate the existence of a nearby fire.

After completing the above operation with respect to a given terminal unit, the CPU 12 cyclically accesses the remaining terminal units, which typically can number, for example, 126 units in a loop.

In the event that one or more terminal units 20 are in the alarm state, supervisory personnel can then identify the general location of the fire by means of the display at the central station panel. At the location, they can look for the indication given by the individual unit's display circuit 30 in order to confirm the exact location where the fire has broken out. However, as will be understood from what has gone before, in the case where a terminal unit is in the form of a transponder having slave detectors, there will be a display at a slave detector only in the case of an alarm being present at the first of the detectors connected to a particular transponder. Otherwise, that is, if there is more than one slave detector in alarm, all the slave detectors will be disconnected, as will be described, and only the light emitting display forming an integral part of the transponder will provide an indication as blinked.

It will be apparent that the loop controller 10 in the preferred embodiment of FIG. 1 can be any one of a number of standard computers presently on the market. The transmission circuit or interface 16 uses a standard I/O technique for serial-to-parallel data conversion. Likewise, the address comparator 24, the A to D converter 28, and detector 34 are devices that implement techniques well known in this art. The command discriminator 26 may consist of an integrated circuit known as EWDI06, manufactured by Fuji Electronics Limited.

As has been noted, two separate lines, identified as DIO1 and DIO2, extend from the command discriminator 26 to two separate circuits, one of which is a display circuit 30 comprising a light emitting diode or similar device, the other line DIO2 being connected to a test circuit comprising a suitable relay or the like which operates to activate the testing of the terminal unit's initiating device (detector 34) and its sensing capability.

Before launching into a description of the feature of the invention according to which a special blinking routine is introduced into the programmed operation, it is well to consider the embodiment of FIG. 2, in which provision is made for adapting the arrangement previously described in connection with FIG. 1 to the situation where a transponder, here designated 20', is involved. Thus, as will be noted in FIG. 2, substantially all of the same components as in FIG. 1 are included. However, for simplicity of illustration, the chip 50 represents the inclusion of the same transmission circuit, A to D converter, address comparator, and command discriminator as previously seen in FIG. 1. The same display circuit 30' is provided as part of the transponder. Also provided, and shown within the dashed lines representing the transponder 20', is a decoder 52, whose operation will be described, a disconnect circuit 54, a test circuit 32', and a reset circuit 58, as well as an electronic switch 60.

External to the transponder 20' is a slave initiating device (e.g. detector 61), which may have its own light emitting device 62, such detector being one of many that can be connected to a conventional line 64 terminated by a resistor 66.

It will be appreciated that in the terminal unit 20 of FIG. 1 previously discussed, the lines DIO1 and DIO2 were connected directly to the respective display circuit 30 and test circuit 32. In contrast, in FIG. 2 the lines DIO1 and DIO2, which likewise constitute outputs of a command discriminator, are taken as inputs to decoder 52 and transformed by logical operations well known in the art of decoding. The individual bit signals, taken together, that is, zero or one, for each of the lines DIO1, DIO2 are used to selectively activate display circuit 30', disconnect circuit 54, test circuit 32', and reset circuit 58.

In the case of display circuit 30', it is arranged by the decoder that when DIO1 line has a 1 signal and DIO2 line likewise has a 1 signal, the display circuit will become activated; whereas when the DIO1 line has a 0 present and the DIO2 line has a 1 present, the test circuit 32' will become activated and the display circuit 30' will be deactivated.

On the other hand, the disconnect and reset operations are effectuated through electronic switch 60 to control the power supplied to external detector 61. Thus, when the disconnect 54 receives the coincidence of a 1 from DIO1 and a 0 from DIO2, the disconnect function is operative and switch 60 is opened. However, when the signals present are 0 from DIO1 and 0 from DIO2, the reset function is effectuated and the slave loads are re-connected.

It will be understood that this particular combination of signals is received only in the event that the command discriminator has been directed to transmit this combination, and this will only occur when more than one detector 61 is in its alarm state, thereby drawing full current. Otherwise, that is, if there is only one slave detector detecting an alarm' the status signal sent from the A to D converter to the loop controller 10 will be such that the disconnect command will not be sent back from the loop controller and the light emitting device 62 on the slave detector 61 will be continuously illuminated from the time when an alarm condition is detected, and the transponder's light emitting devices will be commanded on.

Figure 2:
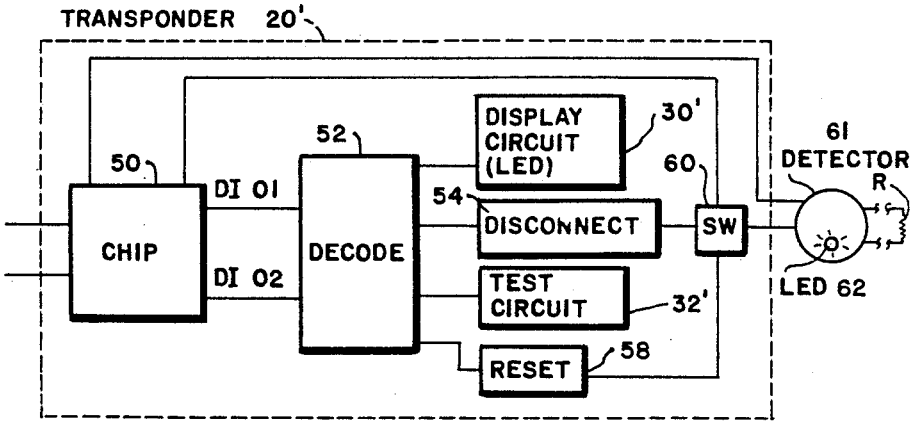
FIG. 2 is a block diagram of one of the terminal units, i.e., a so-called transponder, which includes a master unit and at least one slave detector of conventional type.

Having described the automatic disconnect feature which minimizes power consumption in the transponder situation, attention will now be turned to the arrangement for minimizing power consumed by light emitting devices throughout a given loop regardless of whether the exemplary terminal unit 20 in FIG. 1 or the transponder form of terminal unit, that is, transponder 20' of FIG. 2, is involved.

It will be understood that the blinking routine to be described provides a useful visual indication of an alarm condition such that supervisory personnel can have a reasonable idea of the location of the particular unit or units in alarm. Moreover, the very fact that the illumination is in a blinking mode provides a higher degree of visibility. Also, since the devices, as will be described, are blinked in groups, the total power consumption at any time, worst case, is equal to the light emitting device current times the number of devices in the group. Accordingly, the total power consumed, no matter how large the number of groups, is always equal to the power consumed by one group because of the time sharing aspect afforded by the blinking routine.

As will be apparent by referring to the table immediately below and to the flowchart in

TABLE

| | BLINKING ROUTINE | |
|---|---|---|
| TOTAL NUMBER OF ALARMED DEVICES | TIME ON | TIME OFF FOR EACH DEVICE |
| 1 | ALWAYS | — |
| 2–11 | 0.5 SEC | 0.5 SEC |
| 12–16 | 0.5 SEC | 1.0 SEC |
| 17–21 | 0.5 SEC | 1.5 SEC |
| 22–26 | 0.5 SEC | 2.0 SEC |
| 27–31 | 0.5 SEC | 2.5 SEC |
| 32–36 | 0.5 SEC | 3.0 SEC |
| 37–41 | 0.5 SEC | 3.5 SEC |
| 42–46 | 0.5 SEC | 4.0 SEC |
| 47–51 | 0.5 SEC | 4.5 SEC |
| 52–56 | 0.5 SEC | 5.0 SEC |
| 57–61 | 0.5 SEC | 5.5 SEC |
| 62–66 | 0.5 SEC | 6.0 SEC |
| 67–71 | 0.5 SEC | 6.5 SEC |
| 72–76 | 0.5 SEC | 7.0 SEC |
| 77–81 | 0.5 SEC | 7.5 SEC |
| 82–86 | 0.5 SEC | 8.0 SEC |
| 87–91 | 0.5 SEC | 8.5 SEC |
| 92–96 | 0.5 SEC | 9.0 SEC |
| 97–101 | 0.5 SEC | 9.5 SEC |
| 102–106 | 0.5 SEC | 10.0 SEC |

TABLE-continued

| BLINKING ROUTINE | | |
|---|---|---|
| TOTAL NUMBER OF ALARMED DEVICES | TIME ON | TIME OFF FOR EACH DEVICE |
| 107–111 | 0.5 SEC | 10.5 SEC |
| 112–116 | 0.5 SEC | 11.0 SEC |
| 117–121 | 0.5 SEC | 11.5 SEC |
| 121–126 | 0.5 SEC | 12.0 SEC |

Figure 3:
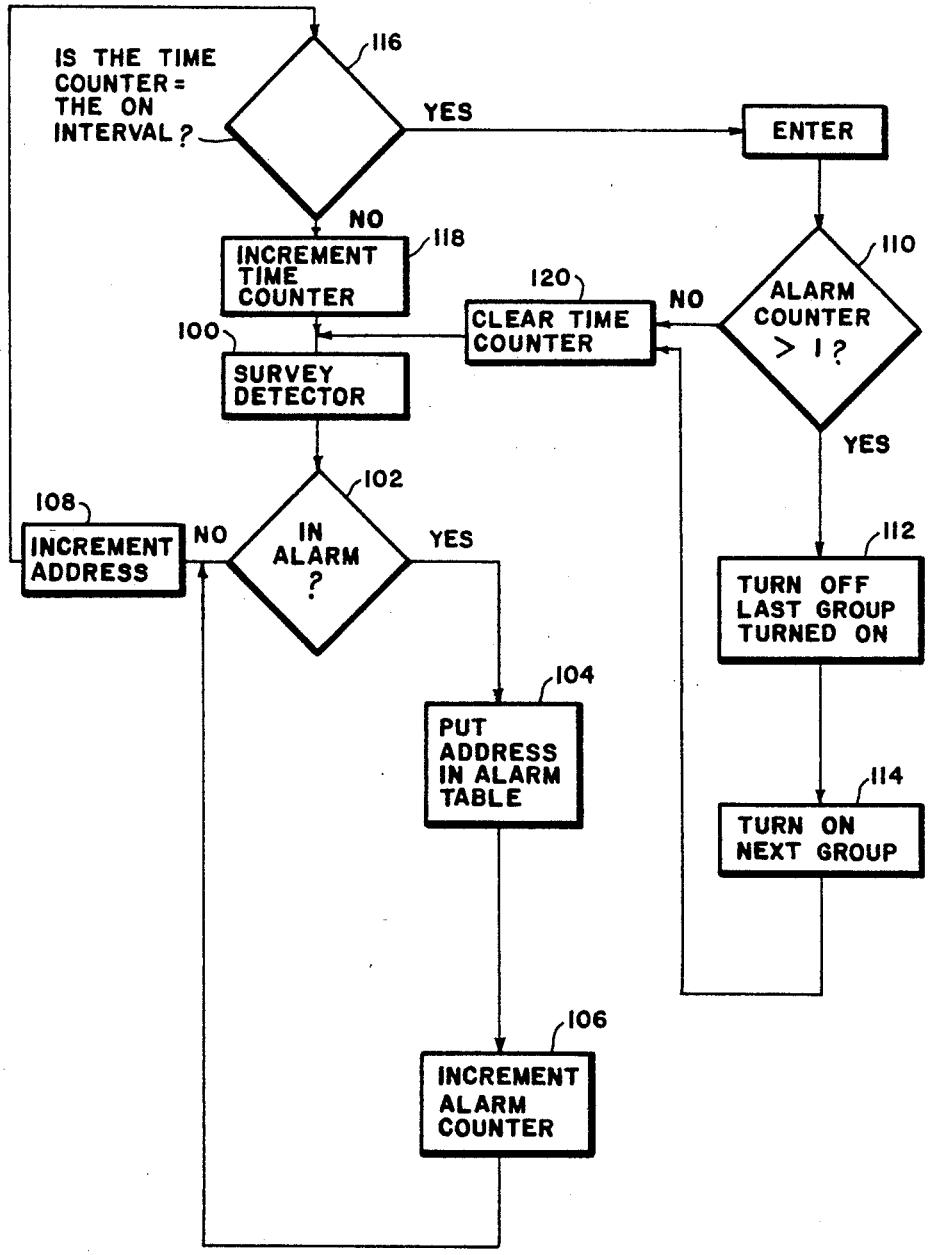
FIG. 3 is a flow chart which depicts the blinking routine for minimizing power supplied to the terminal units.

FIG. 3 of the drawing, the logic for controlling the blinking function resides in the software of the loop controller 10. Thus, referring to the left-hand portion of the operations flowchart in FIG. 3, it will be understood from the block labelled 100 that a survey or poll is conducted of the detectors in the loops of fire alarm system. When any of the terminal units 20 which has been addressed reports that it is in the alarm state, as denoted by decisional block 102 (Yes), the next operation is to load that address into the alarm table (block 104) and then to increase or increment the alarm counter (block 106). It should be understood that the number of groups of alarms is determined by how many terminal units are registered in the alarm count (block 106).

Following the operation of incrementing the alarm counter, there is an incrementing of the address; that is, the next terminal unit is addressed in accordance with operation 108. Also, in the event that, at the operational block 102, the answer is "no" to the inquiry as to any units being in alarm, then incremental addressing also takes place.

Next, the time counter is compared to the ON interval (block 116), in this case, ½second. If not equal, the time counter is incremented (block 118) wIth another unIt of tIme and the poll Is contInued. When the time counter equals the ON interval, then the routine on the right in the flow chart will be executed.

On the right in the flowchart of FIG. 3 it will be seen that initially there is an ENTER operation. The first subsequent operation at block 110 is to determine whether the address counter has a count greater than 1. If yes, the next operation 112 turns oft the first group of light emitting devices by the appropriate code in the protocol stored in the loop controller memory 14, and the second group is turned on. It will be recalled from the table (provided above) that if there is only one terminal unit in alarm, that one is always in the alarm state; however, once there are terminal units greater than one in alarm, and as great as eleven, then the total number of light emitting devices illuminated on a loop remains constant at six (the first in alarm plus a group of five). The alarm table already referred to (operation 104) in the loop controller program keeps track of the alarm address in the order that the units come into alarm. Thus, the blinking routine takes the first group of five (second through sixth units in alarm) and turns them on by sending out a command that raises the voltage level on both DIO1 and DIO2 (see FIG. 2 for a transponder), or just raises the level on DIO1 (for new style or analog detectors, FIG. 1). Accordingly, a logic one on DIO1 in FIG. 1 causes the display circuit 30 to be activated, whereas it is necessary to have a logic one present on both DIO1 and DIO2 in FIG. 2 in order to activate display circuit 30'.

After executing block 114, the time counter will be cleared (block 120) and the polling routine will resume. Since the routine on the right in FIG. 3 will not be executed until the time counter is equal to the ON interval, the light emitting devices can only be blinked in increments of the ON interval.

After 0.5 seconds (see the table above, and the flowchart, FIG. 3), the blinking routine is called again and the group of five light emitting devices that were just turned ON are turned OFF (operation 112) by sending a command to lower DIO2, but leave DIO1 raised (for a transponder) or lowering DIO1 (for an analog detector). The blinking routine takes the next group of five in the alarm table 104 and turns their light emitting devices on (operation 114).

Again, 0.5 seconds later, the blinking routine is called again and the cycle continues until the entire alarm table has been sequenced through. When the routine reaches the end of the table, it starts at the top with the second alarm that came in.

It will therefore be appreciated that a tremendous saving in power is accomplished because, regardless of the total number of devices in the alarm state, there are never more than five terminal units drawing current for a predetermined ON interval, that is, 0.5 seconds (while the first unit continuously draws current). The time OFF for each device is automatically adjusted by the blinking routine such that as the total number of devices in alarm goes up, the time OFF for each device, except for the first, increases until, as shown in the table, the time OFF is as much as 12 seconds.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

What is claimed is:

1. Apparatus for conserving the power supplied to a plurality of light emitting devices associated with respective terminal units in a fire alarm system or the like comprising:

a transmission line;

a plurality of terminal units connected to said transmission line;

each of said terminal units having comparison means for determining whether a received address signal coincides with an identification address stored in the terminal unit, said comparison means producing an output signal responsive to coincidence;

a loop controller connected to the transmission line for transmitting a plurality of address signals cyclically to said terminal units, said loop controller further including means for generating command signals for causing illumination of the light emitting devices of said terminal units; and means for selecting a blinking mode of operation for said command signals such that respective groups of said light emitting devices are thereby intermittently illuminated at different discrete intervals, said means for selecting being operative such that the ON time periods for all of said light emitting devices, except the first, are the same, but the OFF time periods are varied in dependence on the total number of light emitting devices to be supplied with power.

2. Apparatus as defined in claim 1, in which said command signals are generated in response to respective terminal units being in alarm.

3. Apparatus as defined in claim 2, in which said means for selecting a blinking mode of operation is operative such that the OFF times are varied in dependence on the number of light emitting devices to be supplied with power as their respective terminal units come into alarm.

4. Apparatus as defined in claim 1, in which at least some of said terminal units comprise a master transponder and associated alarm indicating devices.

5. Apparatus as defined in claim 4, further comprising means for disconnecting said associated alarm initiating devices from the line when more than one of said initiating devices is in alarm.

6. Apparatus as defined in claim 5, in which said means for disconnecting includes a decode device.

7. Apparatus for conserving the alarm-state power supplied to a plurality of light emitting devices associated with respective terminal units in a fire alarm system or the like comprising:

a transmission line;

a plurality of terminal units connected to said transmission line;

each of said terminal units having comparison means for determining whether a received address signal coincides with an identification address stored in the terminal unit, said comparison means producing an output signal responsive to coincidence;

a loop controller connected to the transmission line for transmitting a plurality of address signals cyclically to said terminal units;

at least some of said terminal units including at least one master transponder and, associated therewith, a group of alarm initiating devices; and means for disconnecting said group of alarm initiating devices from the line when more than one of them is in alarm.

8. Apparatus as defined in claim 7, in which said loop controller is additionally operative for generating alarm-state display command signals when response data from said terminal units indicates that an alarm state exists for a respective unit, including means for transmitting said command signals so as to produce a visual indication in a blinking mode at the respective light emitting devices of said terminal units that are in an alarm state.

9. Apparatus as defined in claim 7, in which said means for disconnecting includes a decode device.

10. Apparatus as defined in claim 9, in which said transponder further comprises:

a command discriminator;

a pair of line connections between said command discriminator and said decode device;

a display circuit including a light emitting device; a disconnect circuit; a test circuit; a reset circuit; and line connections from said decode device to each of the respective circuits;

a switch, and means for connecting said disconnect and reset circuits to said switch; and a line connection through said switch to said alarm initiating devices, whereby the alarm initiating devices are selectively connected, and the test circuit and display circuit are activated, by means of binary signals at the output of said decode device resulting from variable concurrent combinations of signals on the pair of said line connections between the command discriminator and said decode device.

* * * * *